US006941617B2

(12) United States Patent
Pinto

(10) Patent No.: US 6,941,617 B2
(45) Date of Patent: Sep. 13, 2005

(54) HINGE DEVICE WITH DETENT

(75) Inventor: Ana Christina Pinto, Marinha Grande (PT)

(73) Assignee: Southco, Inc., Concordville, PA (US)

( * ) Notice: Subject to any disclaimer, the term of this patent is extended or adjusted under 35 U.S.C. 154(b) by 6 days.

(21) Appl. No.: 10/341,785

(22) Filed: Jan. 14, 2003

(65) Prior Publication Data

US 2003/0221286 A1 Dec. 4, 2003

Related U.S. Application Data

(60) Provisional application No. 60/348,659, filed on Jan. 14, 2002.

(51) Int. Cl.[7] ..... E05F 1/08

(52) U.S. Cl. ..... 16/297; 16/380; 16/381; 16/386

(58) Field of Search ..... 16/297, 342, 380, 16/381, 386

(56) References Cited

U.S. PATENT DOCUMENTS

| | | | | | |
|---|---|---|---|---|---|
| 106,315 | A | * | 8/1870 | Browne | 16/266 |
| 324,444 | A | | 8/1885 | Wolf | |
| 2,591,476 | A | | 4/1952 | Swanson | |
| 3,439,378 | A | * | 4/1969 | Ennis | 16/384 |
| D269,943 | S | | 8/1983 | Bisbing | |
| 4,490,884 | A | | 1/1985 | Vickers | |
| 4,501,045 | A | | 2/1985 | Boyer | |
| D278,309 | S | | 4/1985 | Vickers | |
| 4,579,473 | A | * | 4/1986 | Brugger | 403/163 |
| D284,931 | S | | 8/1986 | Bisbing | |
| 4,630,333 | A | | 12/1986 | Vickers | |
| 4,847,950 | A | * | 7/1989 | Coleman | 16/363 |
| 4,897,873 | A | | 1/1990 | Beutler et al. | |
| 4,987,639 | A | * | 1/1991 | Baiuley et al. | 16/445 |
| 4,987,640 | A | | 1/1991 | Lin | |
| 5,020,189 | A | | 6/1991 | Grome et al. | |
| 5,048,715 | A | * | 9/1991 | Wolff | 220/832 |
| D344,667 | S | | 3/1994 | Riblett et al. | |
| 5,412,842 | A | * | 5/1995 | Riblett | 16/334 |
| 5,669,106 | A | * | 9/1997 | Daoud | 16/266 |
| 5,943,738 | A | * | 8/1999 | Karfiol | 16/342 |
| 6,701,573 | B1 | * | 3/2004 | Ciavarella et al. | 16/266 |

FOREIGN PATENT DOCUMENTS

| | | |
|---|---|---|
| GB | 404854 | 5/1933 |
| GB | 1391215 | 8/1972 |
| GB | 2052618 | 6/1980 |
| GB | 2125497 | 8/1983 |
| GB | 2193528 | 6/1987 |
| GB | 2224538 | 2/1989 |

* cited by examiner

*Primary Examiner*—Suzanne Dino Barrett
*Assistant Examiner*—Mark Williams
(74) *Attorney, Agent, or Firm*—Paul & Paul

(57) ABSTRACT

A wing or leaf-type hinge assembly for use with a thin panel or lid installation includes a manual snap assembly of its pivot pin. The pivot pin structure includes an interlock, which requires a positive release for disassembly. A backer support plate permits the sandwiching of the thin panel between one wing or leaf member of the hinge and the support plate. A detent mechanism may be included which assists in maintaining (holding) the hinge assembly in a pre-selected position. A sensor may be added to detect the hinge assembly in the open position. Mounting structures assist in the easy mounting of the hinge with fewer fasteners.

10 Claims, 12 Drawing Sheets

HINGE DEVICE WITH DETENT

The present application claims priority of U.S. Provisional Application No. 60/348,659, filed Jan. 14, 2002, for Hinge Device with Detent Feature.

BACKGROUND OF THE INVENTION

The present invention relates to hinges for supporting thin doors, panels, lids, and thin covers and the like.

Various types of hinge assemblies are known in the art and are particularly useful for securing a door, cover or the like to a frame or other hinging surface. In many cases, hinge assemblies include multiple parts that must be connected and assembled for installation. There are leaf hinges which can comprise a single piece hinge member, which itself, may consist of a group of elements. A leaf hinge typically has one "wing" plate mounted to a door panel and another wing plate mounted to a frame, thereby facilitating the door panel to swing relative to the frame. There are also adjustably provided hinges that contain elements that can be adjusted to position the hinge. The addition of the adjustment elements, while facilitating the positioning of a hinge, also increases the installation time and the production cost.

Generally hinges have been known to include a pair of opposite parts that are pivotally connected to one another by a pintle serving as a vertical pivot pin. For example, it is customary to provide a simple pintle consisting of a cylindrical shaft that can slide into interlocking barrels on each wing plate to hold the hinge together. The pintle can be provided with a head that engages the upper side of the uppermost hinge knuckle to hold the pintle in position. Generally, the pin is maintained by its configuration and gravity.

It is further known to provide a pintle of a composite construction and having a torsion spring which acts against the leaf hinges for automatically swinging the door to a closed position. When the leaf hinge is installed in the usual manner, one hinge leaf is attached to the door panel edge and the other hinge leaf is attached to the frame. Usually, this type of hinge can be concealed between the door edge and the frame, with the hinge knuckles being visible. This type of hinge, however, has the problem of being susceptible to permitting unauthorized access to an enclosure by removing the hinge pintle. Although some solutions have been provided by furnishing additional hinge components, such as the "hinge pintle retaining means", shown by Curry, et al. in U.S. Pat. No. 4,073,037, the added components make the hinge more complex, and can increase installation and production costs.

Such leaf hinges, as shown by Curry et al. do not solve the fundamental problem of the hinge coming loose or the hinge bending the thin panel or lid to which it is attached. Moreover, with leaf hinges, the pivot pin is usually driven into the barrel shaped bosses (Curry et al. knuckles). For thin panel and thin lid installations, this requires special care, including the use of a special tool.

What is needed is an easy to assemble hinge for holding an pivoting relatively flimsy or thin panels or lids.

What is further needed is such a hinge assembly that does not require driving a pivot pin or pintle into position.

What is even further needed is such a hinge assembly that includes a support or reinforcement for attachment of the leaf or wing to the relatively thin plate or lid.

What is also desired is a detent mechanism with the hinge assembly that assists in holding the hinge assembly in pre-selected position.

What is further desired is an indicator that provides a signal when the hinge is opened.

SUMMARY OF THE INVENTION

An object of the present invention is to provide a wing or leaf-type hinge assembly that can be readily installed on a thin panel or lid.

Another object is to provide this hinge assembly with a backing plate for increased durability and for covering attachment parts.

A further object is to provide this hinge assembly with snap together locking of the pivoting leaf or wing members without the need for tools.

An even further object is to provide this hinge assembly with a detent mechanism that assists in holding the hinge assembly in a pre-selected position.

An additional object is to provide this hinge assembly with an open position sensor.

The objectives of the present invention are realized in a two-piece wing or leaf-type hinge assembly also having a backer-plate. The assembly includes a male wing member carrying a pivot pin, integral with its structure. The female wing member includes a receiving bore or barrel in which the pivot pin rides, thereby permitting the pivoting of the hinge. The two wing members can be manually snapped together when the pivot pin of the male wing member is snapped into the barrel of the female wing member.

The free end of the pivot pin includes a positive interlock, which resists the removal of the pivot pin structure and the disassembly of the two wing members without the release of the interlock.

The hinge is capable of 180 degrees of rotation. The pivot pin may have its free end shaped to receive a co-acting detent member for holding the hinge in a pre-determined rotational position. The detent member may be spring biased. The detent may also be assembled manually.

The backer plate provides support for a thin panel or lid to which the female wing member is mounted. In so mounting to a thin panel or lid, the thin panel or lid is sandwiched between the backer plate and the female wing member. The male wing member has a mounting hole or slot for receiving a fastener. The female wing member may also have one or more fastener holes aligned with fastener holding sockets or brackets in the backer plate. Alternately the backer plate can carry a mounting bolt on its panel or lid mounting face. Further, the backer plate can include positioning pins or dowels.

Through holes are required in the thin panel or lid for any positioning pins or dowels and for fasteners between the female wing member and the backer plate. The backer plate can include a cover over.

BRIEF DESCRIPTION OF THE DRAWINGS

The features, advantages and operation of the present invention will become readily apparent and further understood from a reading of the following detailed description with the accompanying drawings, in which like numerals refer to like elements, and in which.

DETAILED DESCRIPTION OF THE INVENTION

The present invention is a hinge assembly having leaf or wing-type plate members, this hinge assembly being suitable for mounting to a thin panel or lid and having a snap-together configuration. The hinge assembly includes a male wing plate member and a female wing plate member joined with a pivot pin for rotation with respect to one another. A backer plate forms a support member for the female wing member, which is mounted to the thin panel itself.

The backer member can carry one or more fastener openings in its face, which abuts the thin panel. This backer member can alternately carry one or more fasteners projecting from its face. A backer member configuration having the fastener openings can also include a cover. Positioning pins or dowels may be present on the face of the backer member for extending through the thin panel and through the face of the female wing member. Such positioning pins can eliminate the need for plural female wing member fasteners.

The male wing member includes a pivot pin projecting from a cylindrical structure terminating in a shoulder extending about the projecting pivot pin. The female wing member includes a receiving barrel for receiving the pivot pin. With the male wing member manually snapped into position on the female wing member the male member's cylinder end rides against the female member's barrel end.

The female wing member's face can include various fastener mounting openings in various configurations.

An interlock holds the pivot pin in the receiving barrel. This interlock can be implemented either with deformable hooks or with a spring biased engaging block and receiving slot. When this receiving slot is cylindrical indentation in the pivot pin a rotational detent function is also incorporated in conjunction with the spring biased engaging block.

A micro-switch sensor may be added to detect a hinge-open condition. When this micro switch is installed a trip finger is added.

Figure 1:
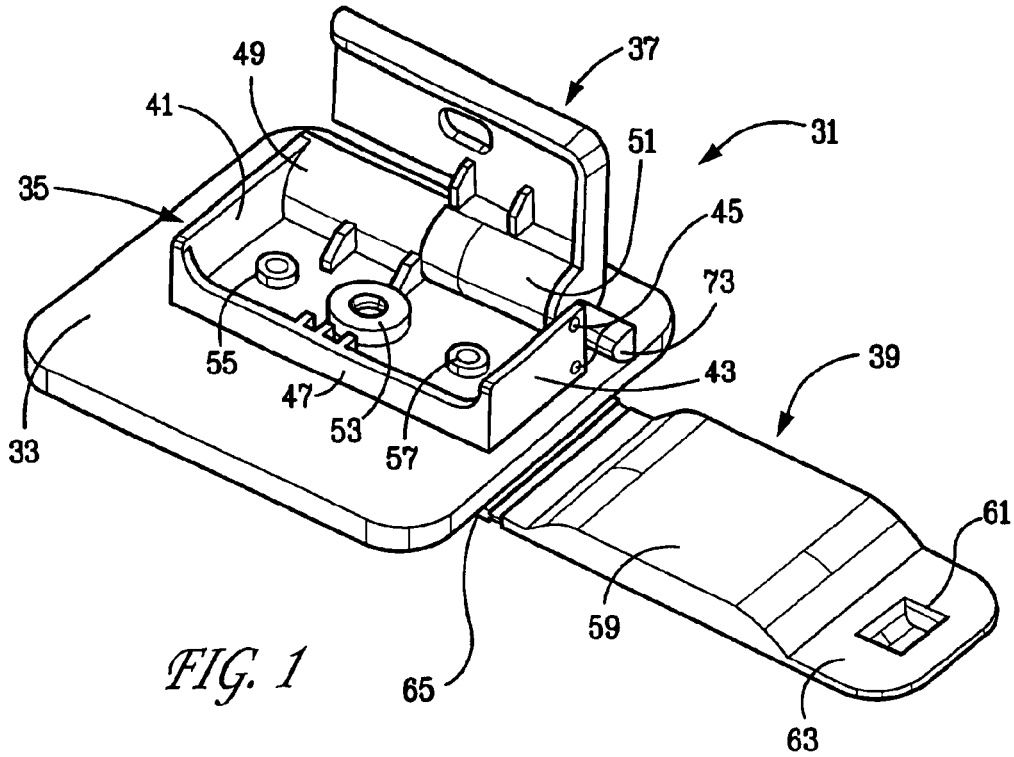
FIG. 1 is a perspective view of the hinge assembly, with the female wing member mounted to a panel and the backer plate and male wing member open.

Referring to FIG. 1, the hinge assembly 31 is mounted on one side to a thin panel 33. This assembly 31 has a female wing plate member 35 seated on the face of the panel 33 with the male wing plate member 37 pivotally connected to the female wing member 35 and opened therefrom. A backer plate 39 seats against the opposite face of the panel 33 and provides structural rigidity to the panel 33 and support for the mounting of the female wing member 35. The female wing member can include opposite first and second end walls 41, 43, respectively. The second end wall 43 can have mounting holes 45 for mounting an accessory, such as a position micro-switch, below discussed.

A perimeter support side wall 47 can join the first and second end walls 41, 43 adding to the rigidity of the female wing member 35. The pivotal connection, of the female and male wing members 35, 37, is facilitated by the abutment of two cylindrical structures 49, 51, that ride against one another. The first is a barrel receiving bore 49 of the female member 35 opposite the perimeter side wall 47. The second is a cylindrical boss-like structure 51 from which the hinge pivot pin (not shown here) extends into the receiving bore 49.

The female wing member's face can include a fastener boss 53, and two positioning bosses 55, 57. Actually, only one positioning boss 55, 57 is needed to secure the female wing member 35 from rotation. Alternately, positioning pins, dowels or tubes 55, 57 may extend from the face of the backer plate 39 through drilled holes in the panel 33 and through holes in the face of the female wing member 35.

The backer plate 39 has a cover 59 portion carrying a fastening knuckle 61 projecting from the face of a tab 63. The backer plate cover 59 is connected to the backer plate body (not shown here) with a living hinge 65.

Figure 2:
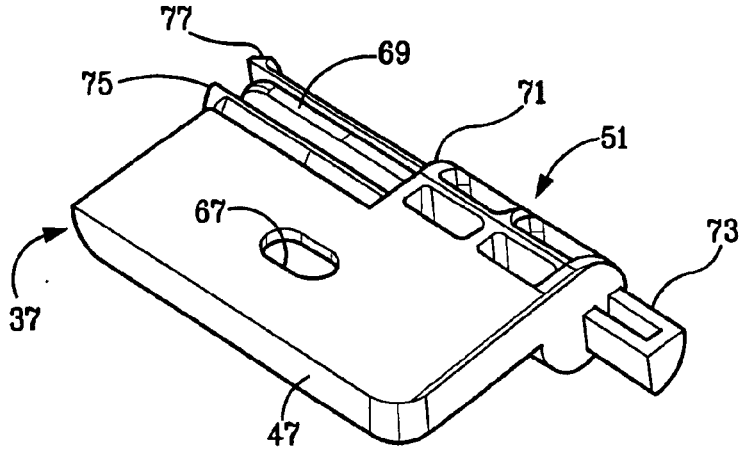
FIG. 2 is a perspective view of the back of the male wing member.

The male wing member 37, FIG. 2, can have an elongate mounting slot 67 in its face for mounting to a fixed member such as a chassis, housing wall or jamb. This slot elongation compensates for any misalignment. Because the pivot pin 69 is rigidly projecting from the male wing member's cylindrical boss-like structure 51 and a flat abutment face 71 surrounds the pin 69, the male wing member 37 and female wing member 35 are reasonably rotationally joined when the pivot pin 69 is fully seated.

When a micro-switch (not shown here) is added to the hinge assembly 31, a trip finger 73 is added to extend from the end of the male wing member 37, with this trip finger 73, FIG. 2, rotating with the male wing member and being adjacent to the mounting area defined by the mounting holes 45, FIG. 1.

Figure 3:
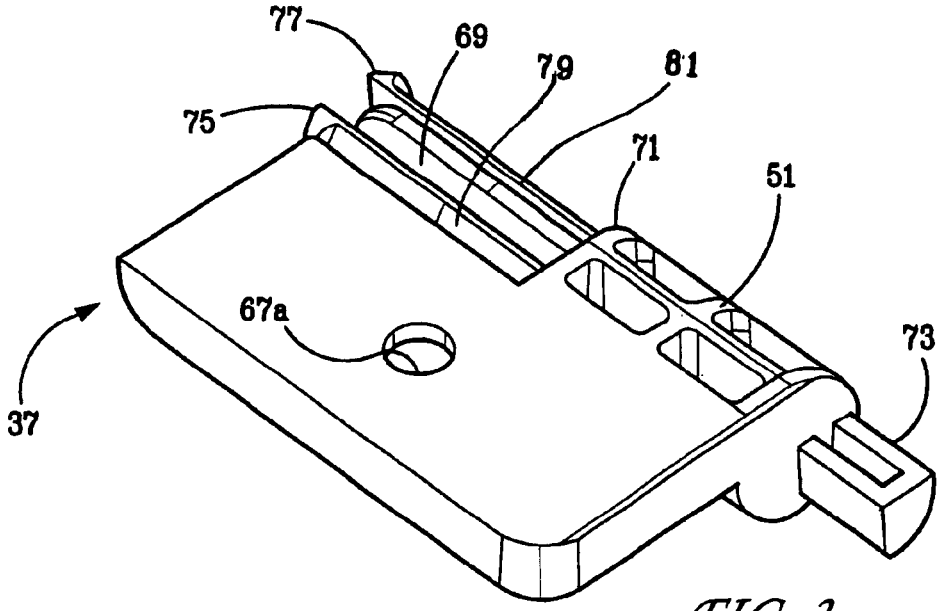
FIG. 3 is a perspective view of the back of the male wing member of FIG. 2 with a circular instead of a slotted fastener hole.

For installations where misalignment is not an issue, the male wing member 37 fastener mounting hole can be round 67*a,* FIG. 3. A pair of bayonet-type hooks 75, 77 extend on diametrically opposite sides of the pivot pin 69, FIGS. 2–3. These hooks 75, 77 have pliable flat ribbon-shaped shafts, 79, 81, respectively; and their heads project beyond the outside end 83, FIG. 4, of the female members' receiving barrel 49 (pivot pin boss 49) to engage the outside face thereof and thereby lock the pivot pin 69 in its fully seated position. These hooks act as an interlock to hold the two wing members 35, 37 together, once they are manually snapped into jointure with one another. The wing members 35, 37, may only be disassembled from one another by depressing the heads of the hooks 75, 77.

Figure 4:
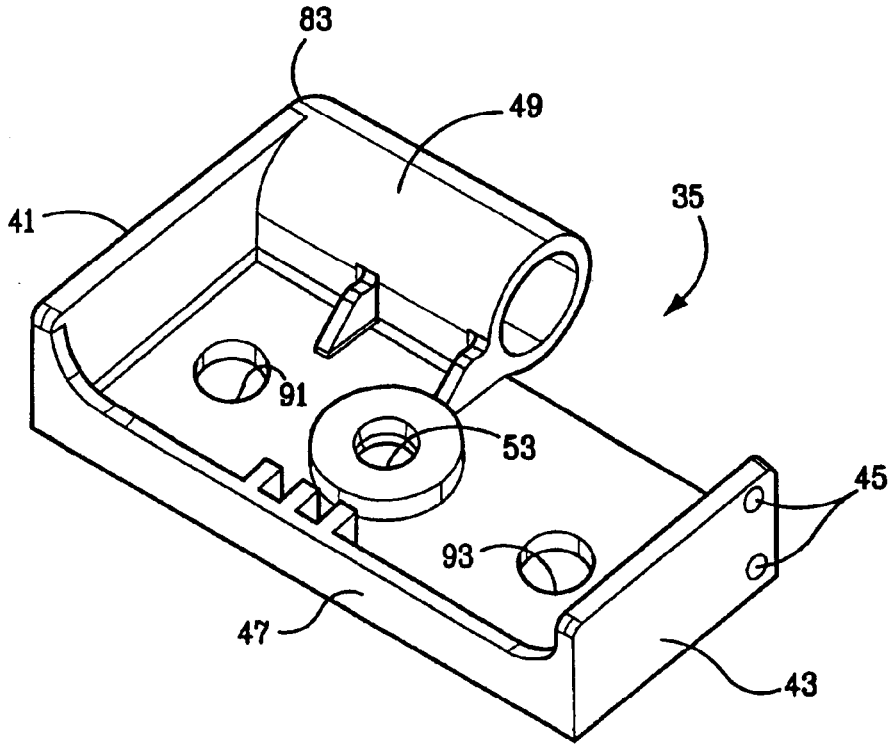
FIG. 4 is a perspective view of the front of the female wing member.

The receiving barrel (pivot pin boss) 49 of the female wing member 35 has a squared-off face 85, FIG. 4, which rides against the face 71 of the male wing member 37.

Figure 5:
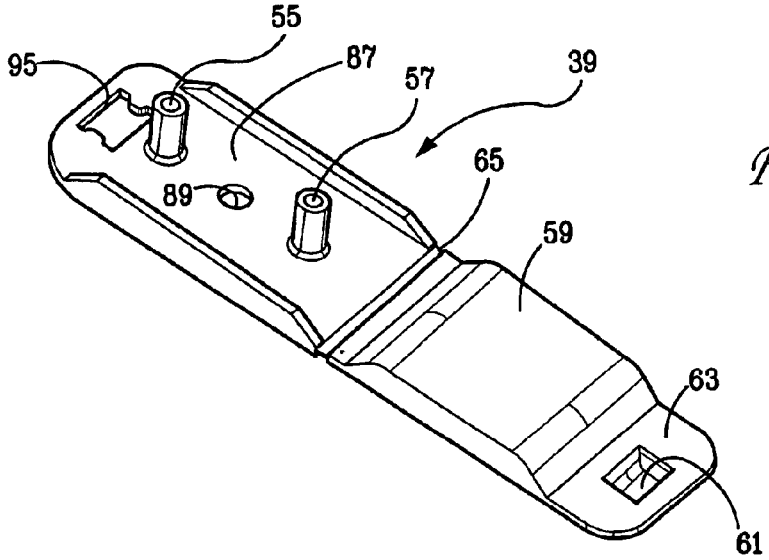
FIG. 5 is a perspective view of the top of the hinged backer plate in the fully open position.

The backer plate 39 is shown in detail in FIG. 5. Easily seen is the living hinge 65 which joins the cover 59 to the body portion 87. A fastener hole 89 is positioned to align with the fastener boss 53 hole, FIG. 1, when the alignment dowels 55, 57 extend through the panel 33 and the respective positioning holes 91, 93, FIG. 4, in the face of the female wing member 35. A rectangular receiving hole 95 at the far end of the body portion of the backer plate 39, receives the knuckle 61 projection to hold the cover 59 closed against the body. The cover 39 is domed to permit a clearance for any fastener nut or head projecting from the back face of the backer plate body 87.

Figure 6:
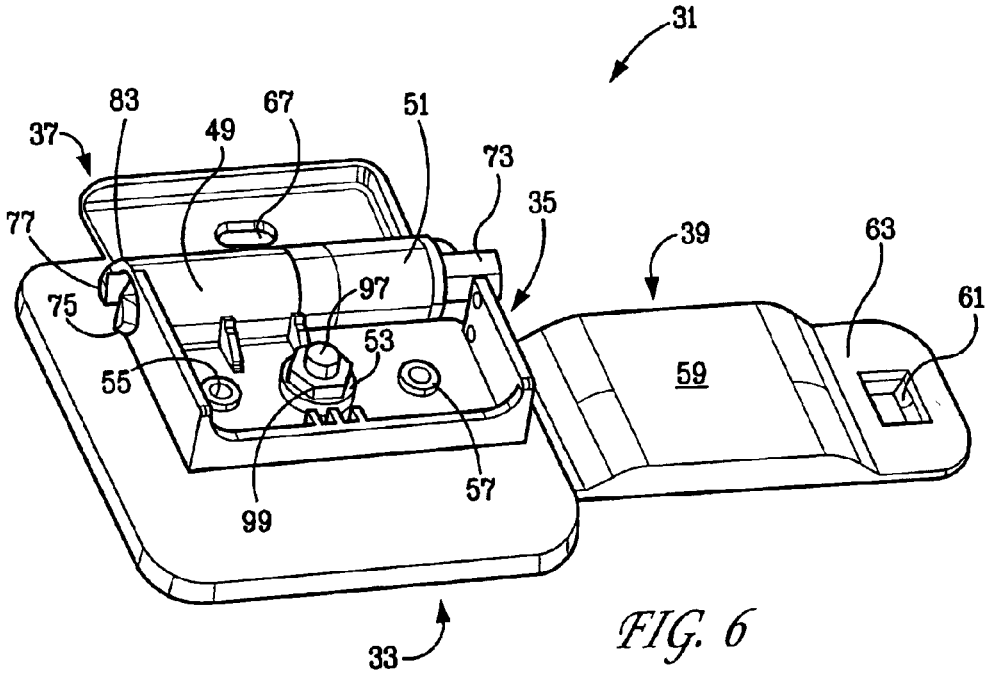
FIG. 6 is a further perspective view of the hinge assembly of FIG. 1 with the mounting fastener in place.

FIG. 6, shows the assembled hinge assembly 31 mounted on the panel 33, with the male wing member 37 rotated 180 degrees from the female wing member 35. The interlock hooks 75, 77 can be seen engaging the far end 83 of the female wing member receiving barrel 49. A bolt 97 extends through the hole in the mounting boss 53 and is held fast with a nut 99.

Figure 7:
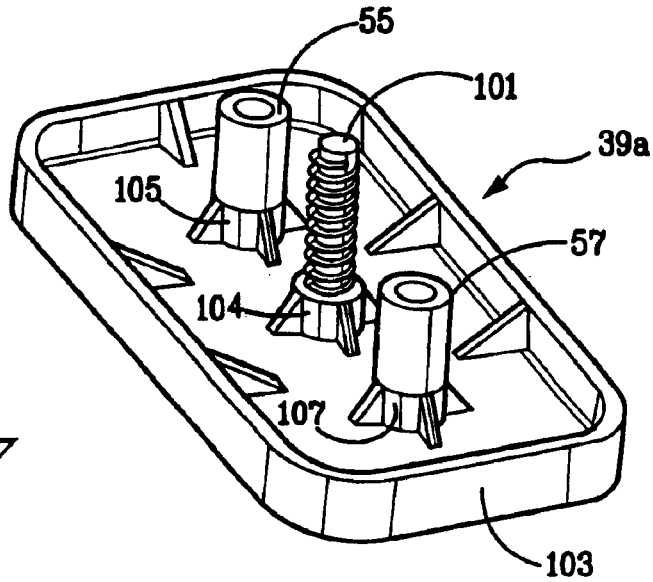
FIG. 7 is a second embodiment for the backer plate for use with the male and female wing member assemblies of FIGS. 1, 5, and 6, showing positioning pins and a mounting threaded screw.

The backer plate 39, FIG. 5, can take other shapes equally as well, such as a rectangular box-like structure 39*a,* FIG. 7. This box-like structure eliminates the need for a cover 59, FIG. 5, but requires a fixed threaded stud 101 to be mounted to the face of this backer plate 39*a*. This box-like backer plate 39*a* includes a perimeter wall 103 of uniform height for rigidity. A treaded receiving bore 104 is formed in the face of the backer plate 39*a,* FIG. 7, for receiving and holding the stud 101. Mounting brackets 105, 107, hold the positioning pins, dowels or tubes 55, 57, respectively. These members, 55, 57 may be glued, welded, press fit or threaded engagement to the mounting brackets at the election of the manufacturer.

Figure 8:
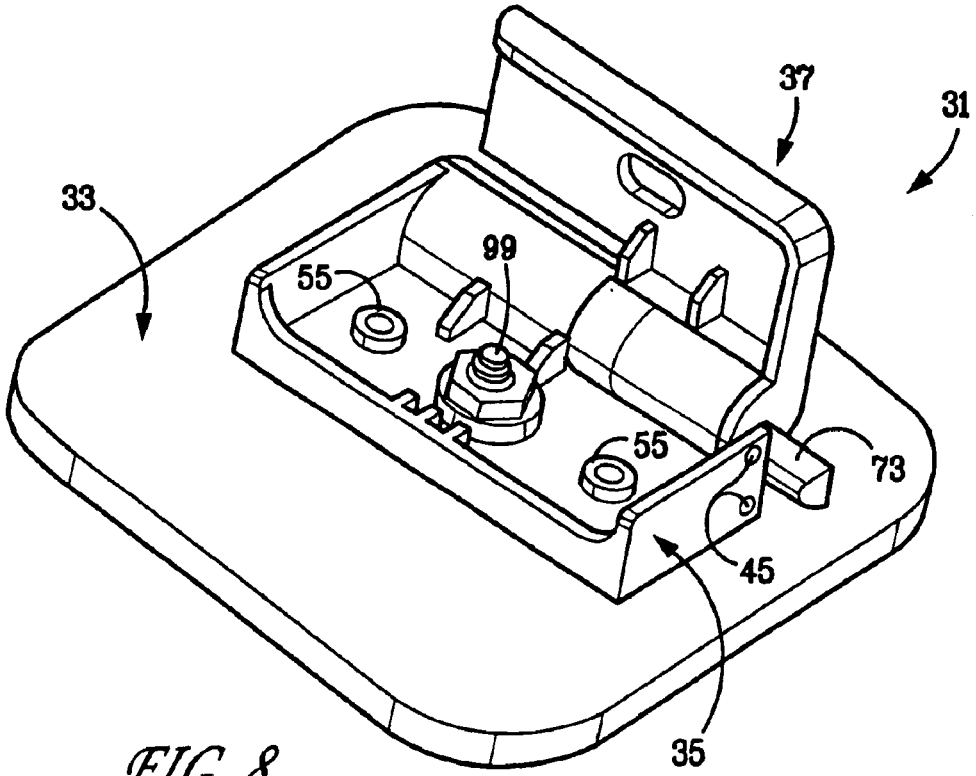
FIG. 8 is a perspective view of the hinge assembly of FIGS. 1–6, with the backer plate of FIG. 7 attached to a panel.
Figure 9:
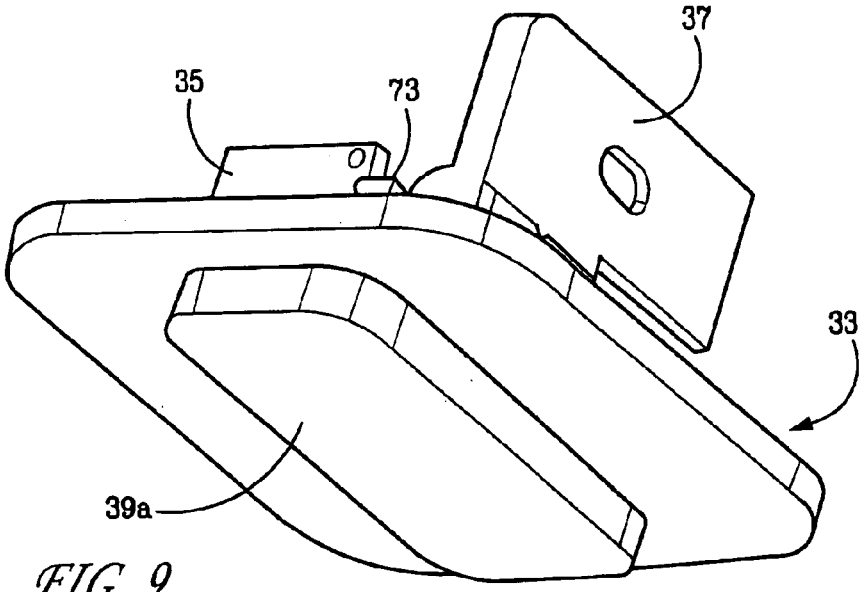
FIG. 9 is a perspective bottom view of the attached assembly and backer plate of FIG. 8.

The assembled hinge 31, with its box-shaped backer plate 39*a* (not shown here) is shown mounted to a panel 33, FIG. 8. In this mounting, the stud 101 replaces the bolt 97 of FIG. 6. A tie-down nut 99 is used. FIG. 9 shows the back of the assembly of FIG. 8.

Figure 10:
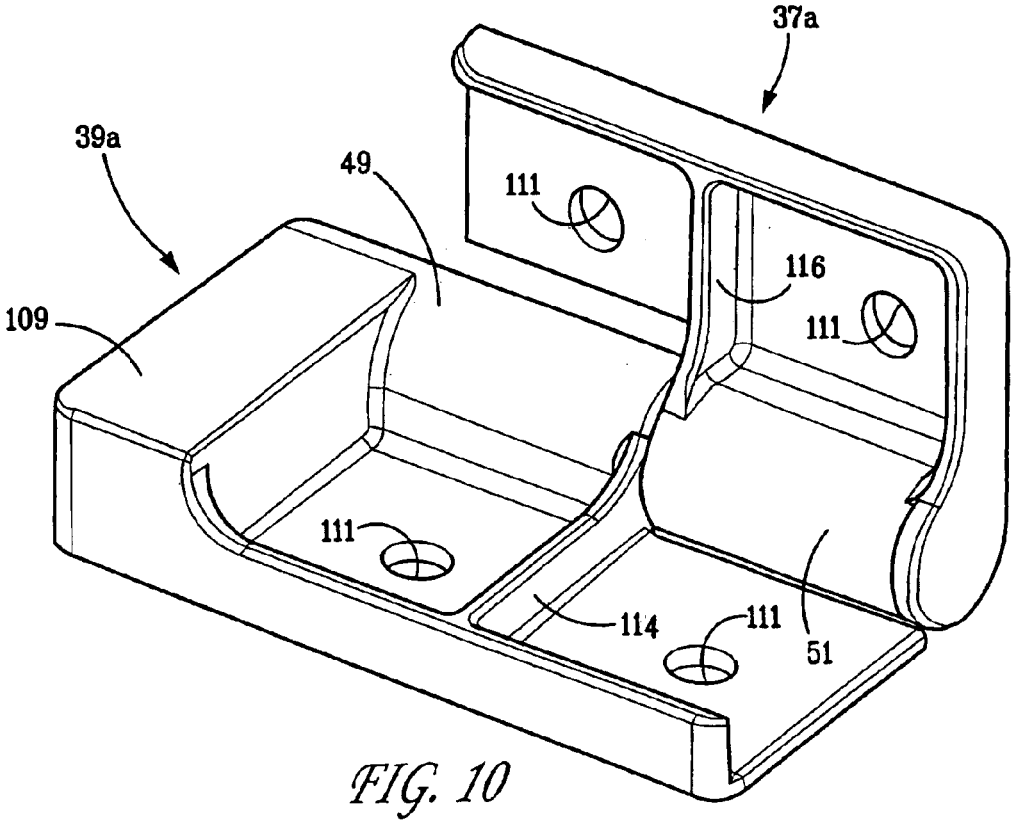
FIG. 10 is a perspective top view of the assembled male wing member and female wing member with two mounting holes in each member's face and with a detent box at one end of the female wing member.
Figure 11:
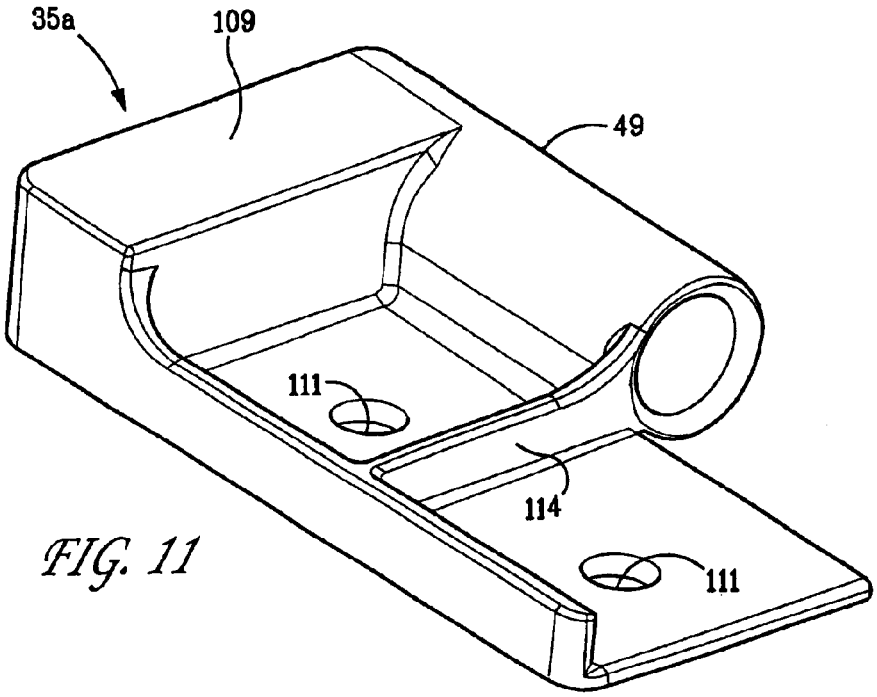
FIG. 11 is a perspective view of the top of the female wing member of FIG. 10.

When the deformable hooks 75, 77, used as the pivot pin 69 interlock are replaced with an engaging block and receiving slot interlock, the female wing member 35*a,* FIGS. 10–11 includes a interlock housing 109, adjacent the outside free end 83 of the female wing members' receiving barrel 49. The female wing member 39*a* and the male wing member 37*a* each carry a pair of fastener mounting holes 111, separated by a reinforcing rib 114, 116, respectively. In this assembly the micro-switch is not to be included, and therefore, the mounting holes 45, and trip finger 73 need not be present.

Positioned within the interlock housing 109 is a biasing spring 113 forcing an engaging block 115 against a mating indentation 117 in the pivot pin 69*a*. This indentation is spaced inwardly from the end of the pivot pin 69*a* to leave an enlarged area or shoulder 119 at the end of the pin. This shoulder 119 and the inward face 121 of the indentation 117 form a "catch" for the mating face of the engaging block 115. When the block 115 is seated in the undercut section or indentation 117 because of the force of the spring 113 asserted against it, a portion of the block remains in the housing 109, therefore the pivot pin 69*a* is locked from removal from the receiving barrel or pivot boss 49.

Figure 12:
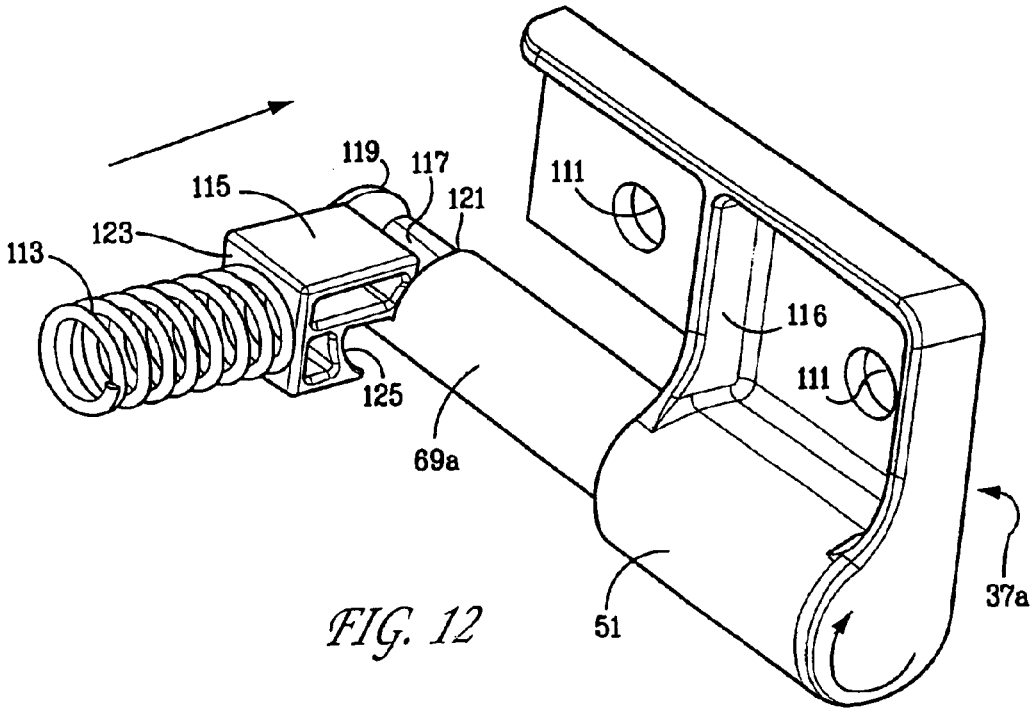
FIG. 12 is a perspective top view of the male wing member of FIG. 10 with the detent mechanism exposed.
Figure 13:
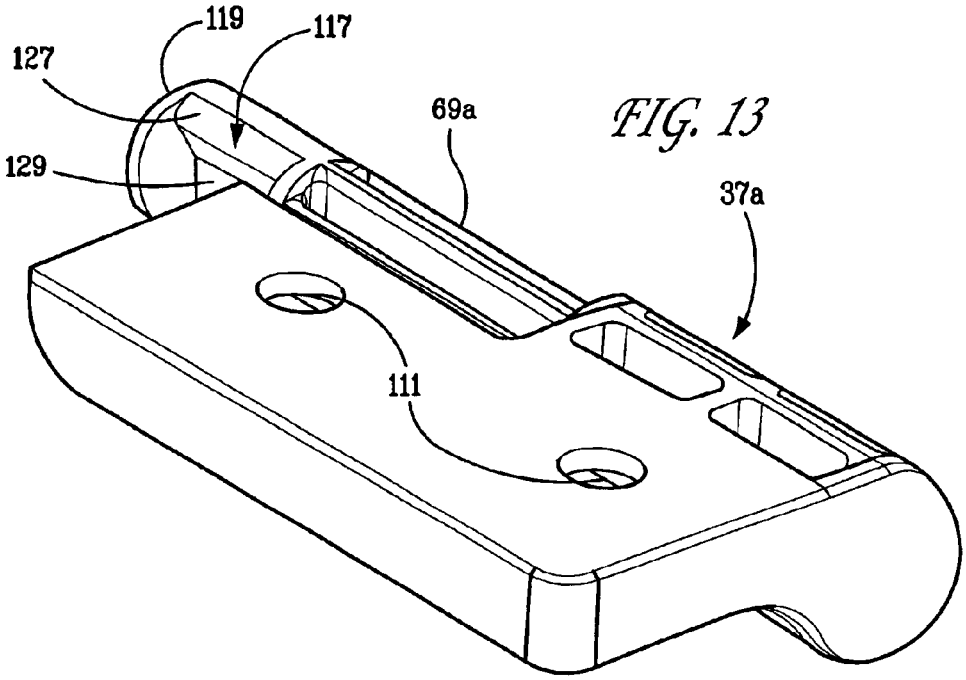
FIG. 13 is a perspective back view of the male wing member of FIGS. 11–12.

The biasing spring 113 is a coil type compression spring which seats at one end against the back inside face of the interlock housing 109 (not shown here) and the abutting face 123 of the engaging block 115. The cross-section of the engaging block can be of any shape, including circular and rectangular as shown in FIG. 12. The pivot pin 69*a* indentation 117 abutment face of the of the engaging block 115 includes a curved face 125 forming a claw-like member. This claw 125 engages the shaped indentation 117 to establish the detent function that holds the hinge male and female wing members 37*a,* 35*a* at a predetermined angle under the force of the spring 113.

The perspective view of the male wing member 37*a* from the back, shows that the pivot pin 69*a* indentation 117 has two steps, a first upper step 127 forming a first shoulder and a second inner step 129 forming a second shoulder. The total rotation of the indentation 117 is to be equal to or greater than the permitted rotation of the female and male wing members 35*a,* 37*a* to each other. Typically this is 180 degrees. The upper step 127 assures the interlock function is always maintained. The inner step 129 operates with the curved face 125 of the engaging block for the detent function.

Figure 14:
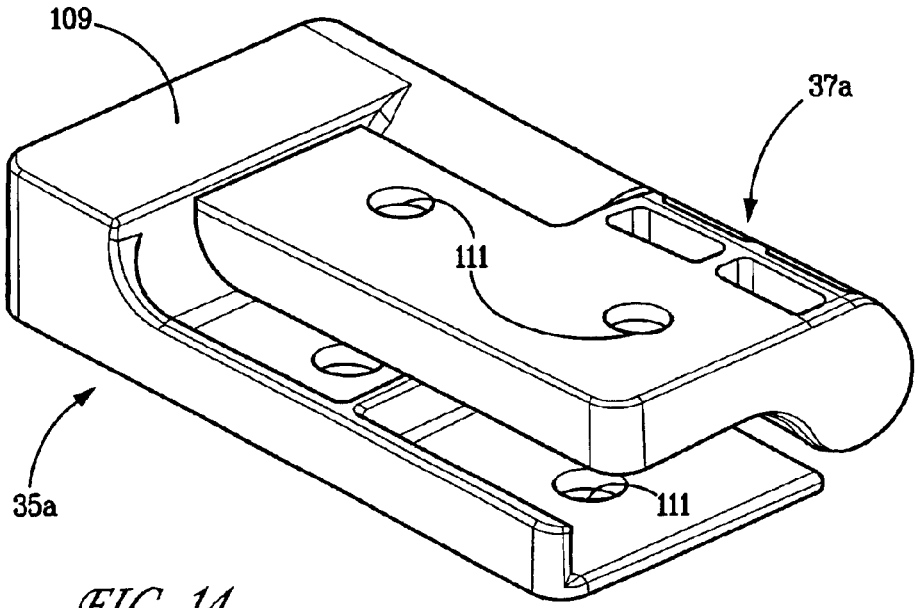
FIG. 14 is a perspective view of the assembled male wing member and female wing member of FIG. 10 closed upon one another.

FIG. 14 shows the closed female and male wing members 35*a,* 37*a,* where the male member faceplate clears the female wing member interlock housing.

Figure 15:
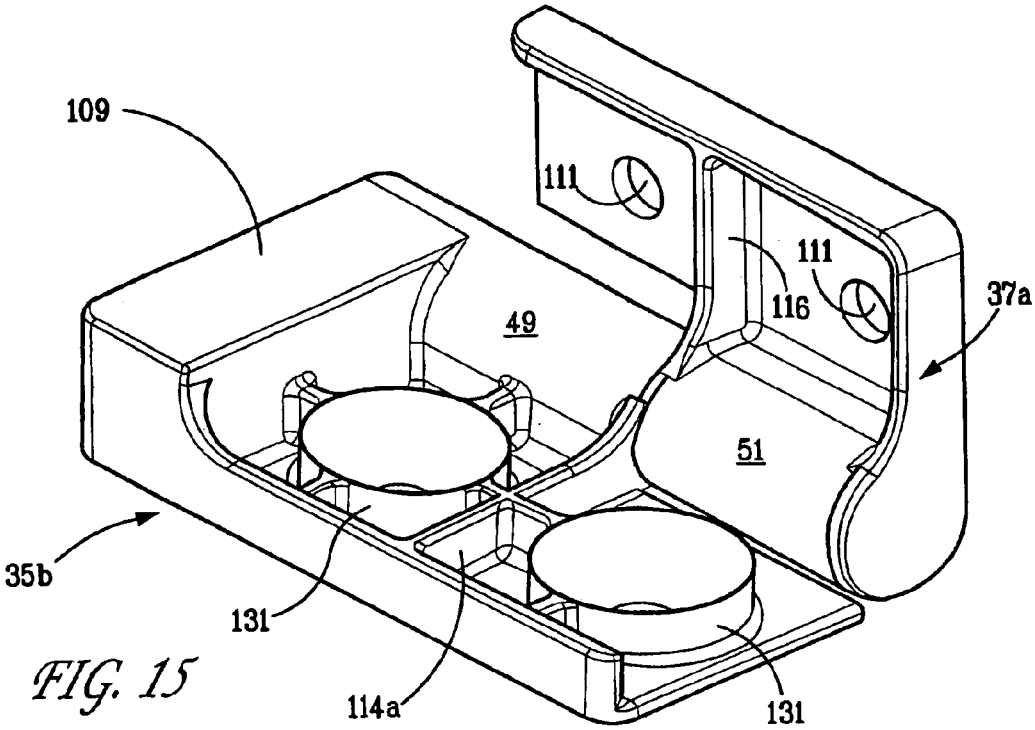
FIG. 15 is a perspective top view of the assembled male and female wing members of FIG. 10, but wherein the face of the female wing member carries counter sinks for receiving and centering fastener heads.
Figure 16:
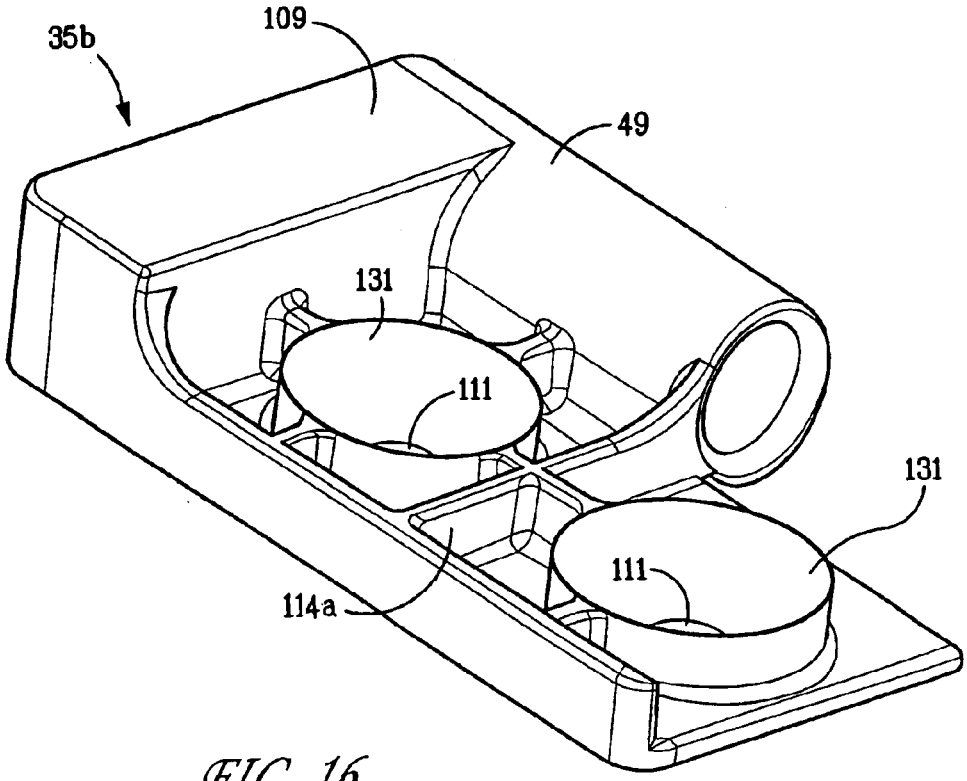
FIG. 16 is a perspective view of the top of the female wing member of FIG. 15.

As previously stated, the mounting holes for the female wing member and male wing member can take many forms. FIGS. 15–16 show counter sink structures 131 formed on the face of the female wing member 35*b,* about the fastener holes 111. FIG. 15 shows the female and male wing members 35*b,* 37*a* assembled together, while FIG. 16 shows just the female wing member 35*b* alone. When counter sinks 131 are present the female wing member support rib is cross-shaped 114*a*.

Figure 17:
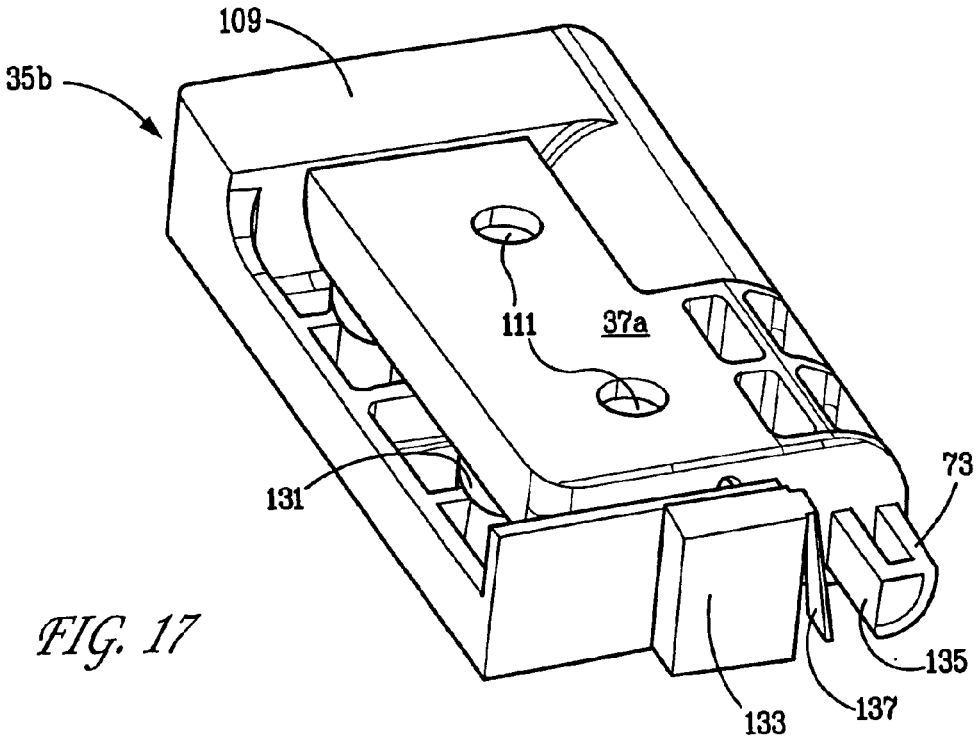
FIG. 17 is a perspective top view of the assembled male and female wing members closed upon one another and showing a micro-switch mounted on the female wing member.

FIG. 17 shows a back view of the closed female and male wing members 35*b*, 37*a,* closed upon one another. Also shown in this FIG. 17 is a micro-switch 133 mounted at the mounting holes 45 and adjacent to the trip finger 73. The trip finger 73 rotates as the male wing member 37*a* rotates.

When a flat face 135 on the trip finger 73 rotates beyond a contact 137 on the micro-switch 133, the body of the trip finger forces the contact 137 to close and the micro-switch 133 to send a signal.

Figure 18:
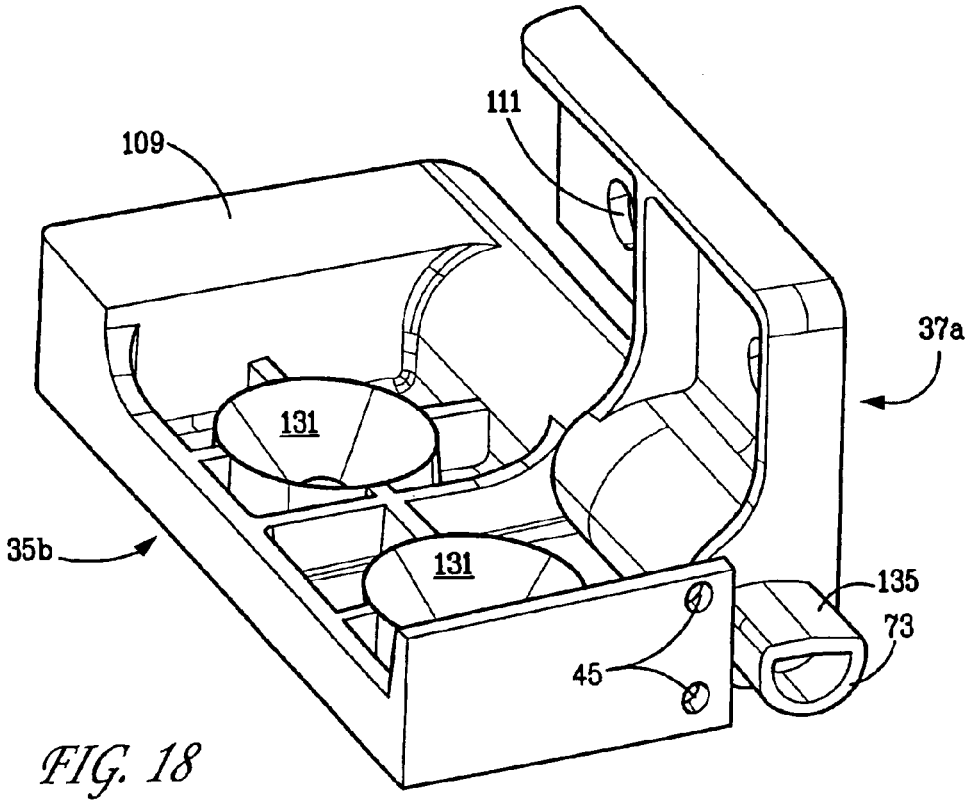
FIG. 18 is a perspective top view of the assemble male and female wing members of FIG. 17 in an open position, with the micro-switch of FIG. 17 removed.
Figure 19:
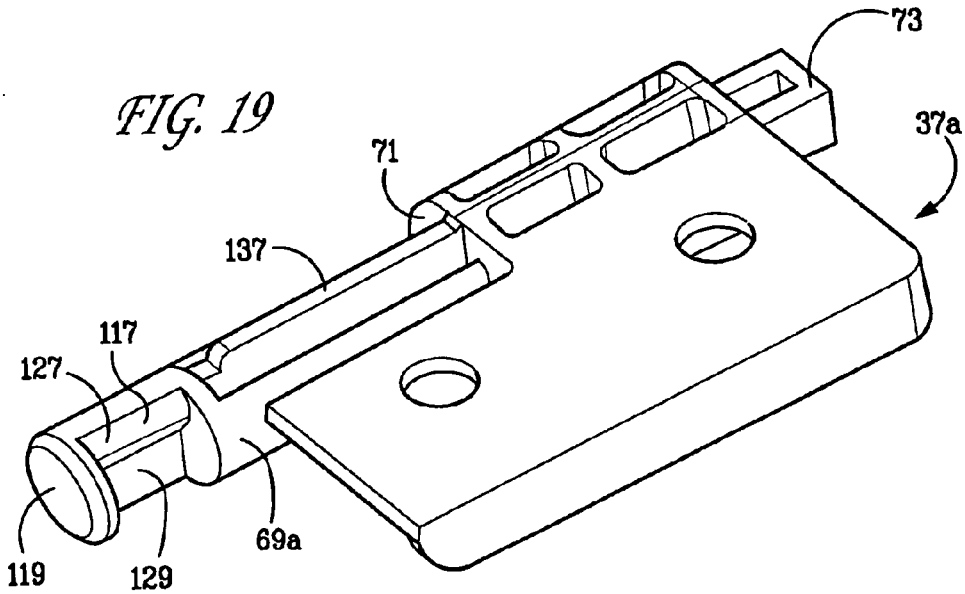
FIG. 19 is a perspective back view of the male wing member of FIGS. 17–18.

FIG. 18 illustrates the closed wing member structure of FIG. 17 in the open position. FIG. 19 shows a back view of the male wing member 37*a,* of FIGS. 14, 17–18 with the trip finger 73 present. Easily seen is the pivot pin 69*a* indentation 117 and upper and inner steps 127, 127 respectively. An elongate rib 137 extends along the shaft of the pivot pin 69*a*. This is an orientation rib 137 which orientates the assembly of the male wing member 37*a,* FIG. 19, on the female wing member 35*b,* FIG. 20. The female wing member's receiving bore 49 includes an arc-shaped undercut 139 in a portion of its inside wall. This undercut 139 accommodates the projection of the rib 137. This undercut has shoulders 141, 143 at each end of its are which act as stops for the counter-clockwise and clock-wise rotation, respectively, of the male wing member 37*a* with respect to the female wing member 35*b*.

Figure 21:
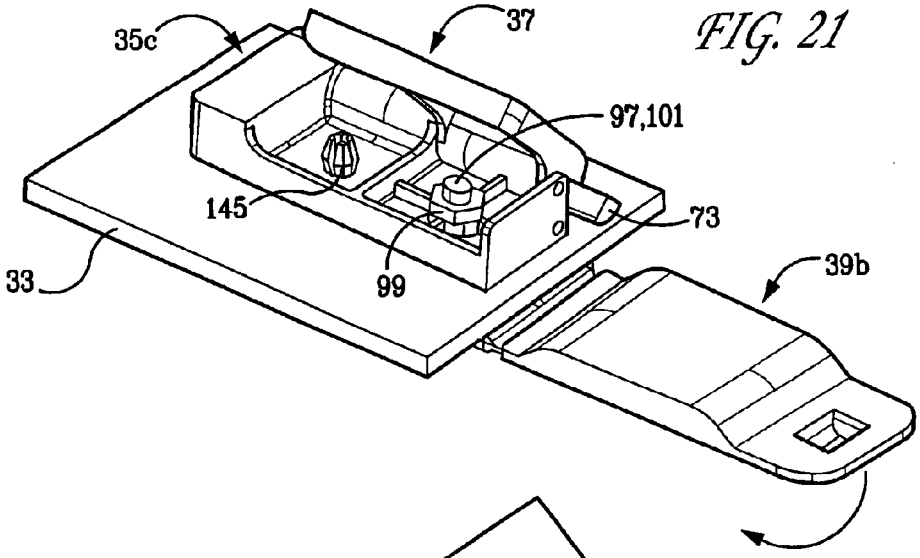
FIG. 21 is a perspective top view of the male and female wing member assembly of FIG. 18, with alternate female wing member mounting holes.

FIG. 21 shows a further variation for the mounting of the female wing member 35*c* and backer plate 39*b* to the panel 33. A compression snap button extends from the body of the backer plate 39*b* through one of the holes in the panel 33 and through a mounting hole in the female wing member 35*c*. A bolt 97 and nut 99 or a stud 101 and nut 99 secure the other mounting hole as previously described.

Figure 22:
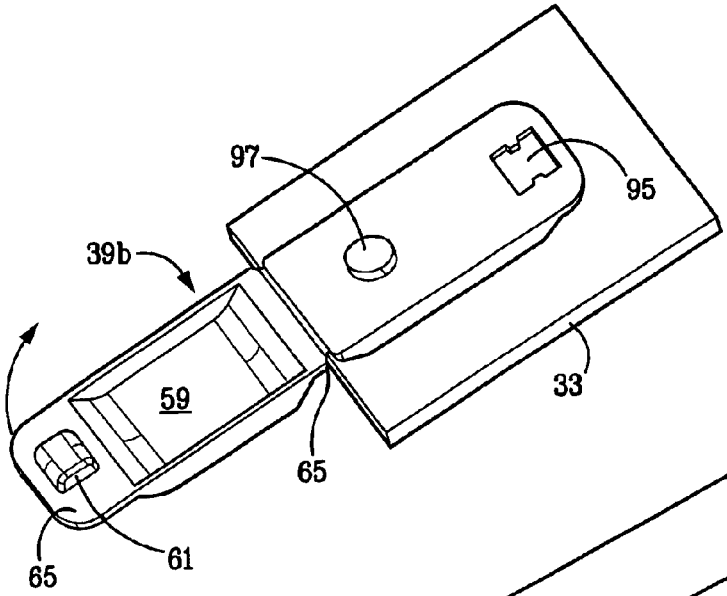
FIG. 22 is a perspective bottom view of an open hinged backer plate mounted on a panel.
Figure 23:
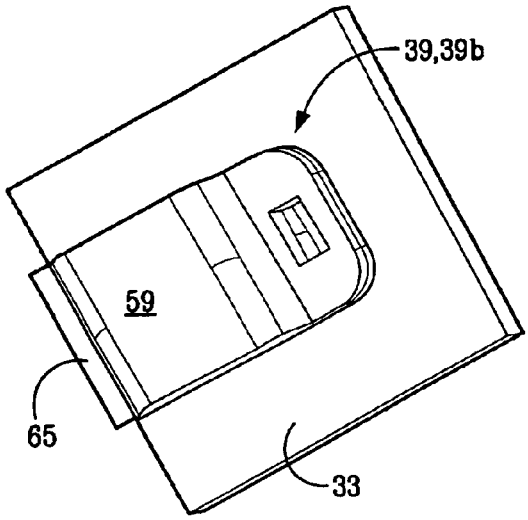
FIG. 23 is a perspective bottom view of the mounted hinged backer plate of FIG. 22 in the closed position.

FIG. 22 illustrates the back of the backer plate 39*b* when a compression snap button 145 and a bolt 97 are used. FIG. 23 illustrates the backer plate 39, 39*b* with the cover 59 in the closed position.

Figure 20:
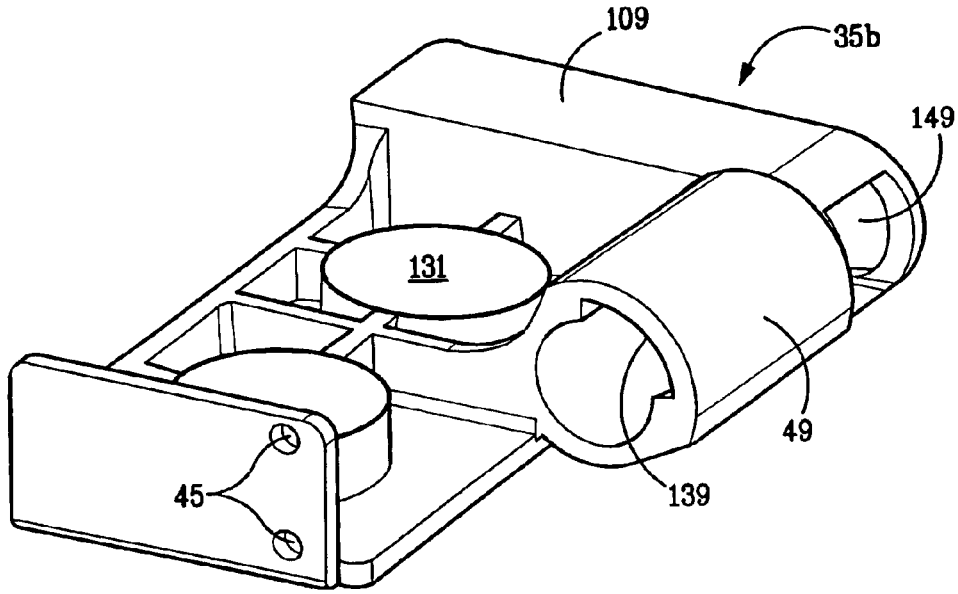
FIG. 20 is a perspective top view of the female wing member of FIGS. 17–18.
Figure 24:
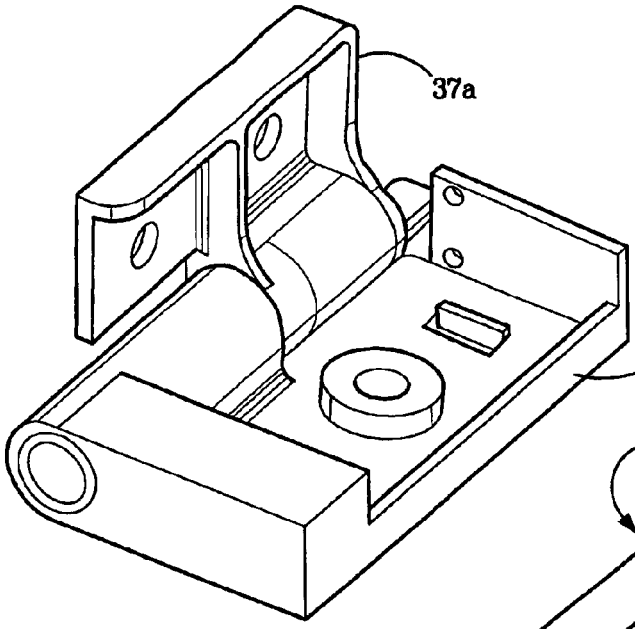
FIG. 24 is a perspective top view of the open male wing member and female wing member assembly of FIGS. 18 and 21 with yet another female wing member mounting fastener pattern.
Figure 25:
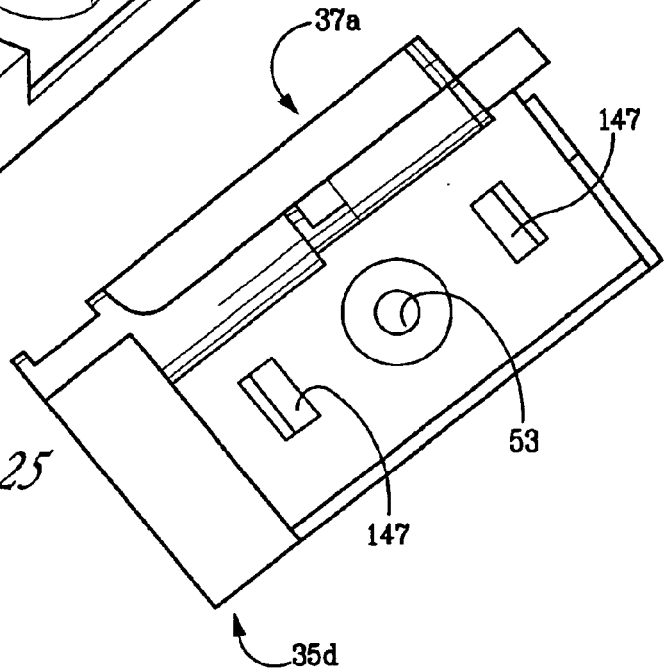
FIG. 25 is a top view of the open male wing member and female wing member assembly of FIG. 25.
Figure 26:
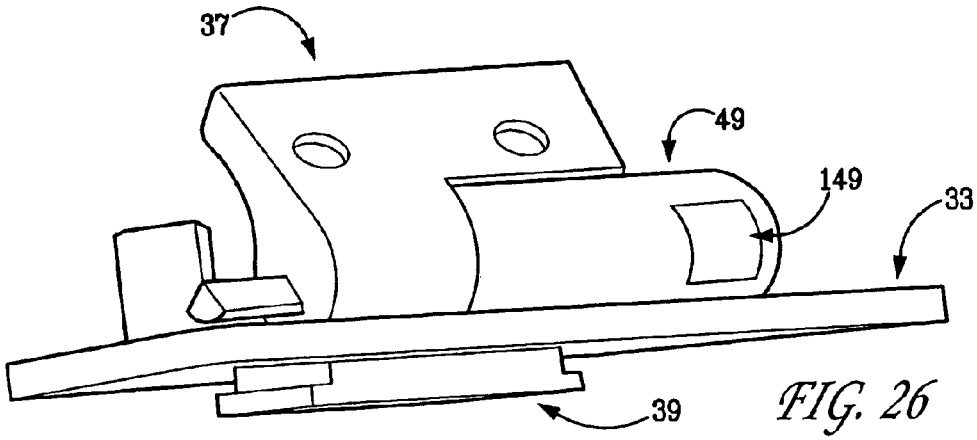
FIG. 26 is a perspective side edge view of the wing member hinge assembly of FIGS. 17–25 showing the backer plate closed.

FIGS. 24–25 show the female wing member 35*d* with yet another mounting configuration, this being a center circular boss 53 for a bolt or stud, and rectangular side openings for a rectangular rib, bayonet or other like structure. FIGS. 20 and 26 show the access port 149 through which the biasing spring 113 and engaging block 115 are inserted into the interior of the interlock housing prior to the insertion of the pivot pin 69*a* into the receiving bore 49.

Many changes can be made in the above-described invention without departing from the intent and scope thereof. It is therefore intended that the above description be read in the illustrative sense and not in the limiting sense. Substitutions and changes can be made while still being with the scope of the appended claims.

What is claimed is:

1. A hinge assembly, comprising:

a first plate;

a second plate including a pivot boss;

a pivot pin seated in said pivot boss and connecting said first and second plates for pivotal rotation with respect to one another; and a detent proximate said pivot pin for locking said pivot pin in position in said pivot boss, wherein said pivot pin is fixedly attached to said first plate, whereof said pivot pin rotates with said first plate rotation to said second plate; wherein said pivot pin has an undercut indentation in a portion thereof inboard from its free end; and wherein said detent includes:

an engaging member for seating within said pivot pin indentation;

means for holding said engaging member in fixed relation to said second plate; and biasing means forcing said engaging member into seating contact with said pivot pin indentation.

2. The hinge assembly of claim 1, wherein said pivot pin indentation has two steps; and wherein said engaging member has a curved surface and a flat surface, whereof, as said pivot pin is rotated, said second indentation step engages said engaging member curved surface holding and thereby holding said pivot pin from further rotation.

3. The hinge assembly of claim 2 wherein said holding of said pivot pin from further rotation is overcome by overcoming said biasing means force on said engaging member.

4. The hinge assembly of claim 1, wherein said indentation creates a shoulder at the end of said pivot pin, said shoulder co-acting with said engaging member to lock said pivot pin in said pivot pin boss.

5. The hinge assembly of claim 1 also including a backer plate positionable to mate with said second plate for holding a panel or lid there between.

6. The hinge assembly of claim 4 also including a backer plate positionable to mate with said second plate for holding a panel or lid there between.

7. The hinge assembly of claim 5, wherein said backer plate carries a positioning member and an attachment member which is capable for projecting into engagement with said second plate.

8. The hinge assembly of claim 6, wherein said backer plate carries a positioning member and an attachment member which is capable for projecting into engagement with said second plate.

9. A detent hinge, comprising:

a. a stationary first hinge part having a body portion, boss portion, a hollow trunk portion with at least one mounting aperture therein, and a box portion opening onto said boss portion; and b. a swinging second hinge part having body portion and a trunk portion with at least one mounting aperture therein, wherein said trunk portion has a first end and a second end;

c. a pin attachment member extending from said second end parallel to said body portion of said second hinge part and parallel to said stationary first hinge part boss portion;

d. wherein said pin attachment member includes a shoulder at the free end thereof and a first upper step and a second inner step extending longitudinally along said pin attachment member inboard from said free end shoulder; and e. a spring biased engaging block operating within said box portion of said first hinge part and through said opening into said boss part to selectively operate against said first and second pin attachment member steps.

10. A hinge assembly for connecting in a swinging relationship a first member and a second member, said hinge assembly comprising:

a) a first hinge part having a body portion with a knuckle and mounting means for mounting said first hinge part to a first member;

b) a pin member connected to the first hinge part body portion and extending outwardly from said knuckle;

c) a second hinge part having a body portion with a knuckle, a pin-receiving bore disposed in said knuckle and extending into said body portion for receiving said pin member therein, and mounting means for mounting said second hinge part to a second member, wherein said pin-receiving bore has a wider first portion and a narrower second portion, there being a ledge formed at the top of the narrower second portion; and wherein a longitudinal opening is disposed in said second hinge part knuckle to provide access to said pin-receiving bore; and d) detent means for maintaining the position of said first member at one or more positions relative to the second member, wherein said detent means comprises a spring member having a body portion with a pair of flexible leg members extending therefrom, said leg members each having a longitudinal projection thereon;

e) wherein said bore wider first portion is defined by a wall, and wherein said defining wall has a plurality of spaced apart longitudinal grooves disposed therein;

f) wherein said spring member body portion has a slot for receiving the pin member therein, said slot being adapted to align with the longitudinal opening of said second hinge part body to receive the pin member therein.

* * * * *